US005624482A

United States Patent [19]

Kijimuta et al.

[11] Patent Number: 5,624,482

[45] Date of Patent: Apr. 29, 1997

[54] INK JET RECORDING SHEET

[75] Inventors: Hitoshi Kijimuta; Yukio Jitugiri; Shinichi Suzuki, all of Yokohama, Japan

[73] Assignee: Asahi Glass Company Ltd., Tokyo, Japan

[21] Appl. No.: 690,399

[22] Filed: Jul. 29, 1996

Related U.S. Application Data

[62] Division of Ser. No. 396,788, Mar. 1, 1995, abandoned.

[30] Foreign Application Priority Data

Mar. 1, 1994 [JP] Japan ..... 6-031588

[51] Int. Cl.[6] ..... B41J 2/01; B41M 5/00

[52] U.S. Cl. ..... 100/31.37; 106/31.69; 347/105; 347/106; 428/195; 428/328; 428/500; 428/532

[58] Field of Search ..... 428/500, 532, 428/328, 195; 347/105, 106; 106/20 D, 19 E

[56] References Cited

U.S. PATENT DOCUMENTS

| | | | |
|---|---|---|---|
| 4,786,288 | 11/1988 | Handa et al. | 106/20 |
| 5,104,730 | 4/1992 | Misuda et al. . | |
| 5,264,275 | 11/1993 | Misuda et al. . | |
| 5,275,867 | 1/1994 | Misuda et al. . | |

FOREIGN PATENT DOCUMENTS

| | | |
|---|---|---|
| 0524626 | 1/1993 | European Pat. Off. . |
| 4323075 | 11/1991 | Japan . |

*Primary Examiner*—Pamela R. Schwartz
*Attorney, Agent, or Firm*—Oblon, Spivak, McClelland, Maier & Neustadt, P.C.

[57] ABSTRACT

A recording sheet of the type on which an ink containing a water-soluble polymer is applied by an ink jet system for recording, which comprises a substrate and a porous alumina hydrate layer containing a gelling agent for the water-soluble polymer, formed on the substrate.

11 Claims, No Drawings

INK JET RECORDING SHEET

This application is a Divisional of application Ser. No. 08/396,788, filed on Mar. 1, 1995, now abandoned.

The present invention relates to a recording sheet suitable for an ink jet recording method. Particularly, it relates to an ink jet recording sheet excellent in the fixing property of ink and the color uniformity.

In recent years, reflecting wide use of ½ inch video systems and electronic still cameras or wide use of computers, the hard copy technology to record images thereof on paper sheets has been rapidly developed. The ultimate target of such hard copy technology is a level equivalent to silver halide photography, and it is an objective for development to bring the color reproducibility, the color density, the resolution, the gloss, the weather resistance, etc. as close as possible to the levels of silver halide photography. For hard copy recording, various systems are available including not only the system wherein a display indicating an image is directly photographed by silver halide photography, but also a sublimation type thermal transfer system, an ink jet system, and a system wherein an electrostatic transfer system is modified for a color printing by various methods by various companies.

An ink jet system printer has been widely used in recent years, since full coloring is thereby easy, and the printing noise is thereby low. In this system, ink liquid drops are ejected at a high speed from a nozzle to a recording material, and the recording material is required to swiftly absorb the ink and have excellent color forming properties.

Therefore, a recording sheet having an inorganic porous layer formed on a substrate has, for example, been proposed in e.g. U.S. Pat. No. 5,104,730. In ink jet recording methods, various inks are used depending upon the printers, and recording sheets are likewise required to have properties suitable for such inks.. The present invention is directed to provide a recording sheet, whereby the ink absorption is excellent, colorants can be effectively fixed to provide a high level of color reproducibility, and a record having a high color density and high durability can be obtained, particularly by an ink jet printer employing an ink having carboxymethyl cellulose incorporated.

The present invention provides a recording sheet of the type on which an ink containing a water-soluble polymer is applied by an ink jet system for recording, which comprises a substrate and a porous alumina hydrate layer containing a gelling agent for the water-soluble polymer, formed on the substrate.

Now, the present invention will be described in detail with reference to the preferred embodiments.

The water-soluble polymer contained in the ink is incorporated for the purpose of adjusting the volatility, the viscosity, etc. of the ink. Specifically, carboxymethyl cellulose, sodium alginate or polyvinyl alcohol may, for example, be used. In the present invention, the gelling agent for the water-soluble polymer is a substance which acts on the water-soluble polymer dissolved in the ink and promotes its gellation. The gelling agent may vary depending upon the type of the water-soluble polymer, and it is necessary to select the gelling agent suitable for the water-soluble polymer in the ink.

In the recording sheet of the present invention, the alumina hydrate contains the gelling agent for the water-soluble polymer in the ink. Accordingly, when ink droplet jetted by an ink jet system attaches to the alumina hydrate, the viscosity of the ink increases, whereby unnecessary diffusion of the ink will be prevented. Therefore, the uniformity of the recorded image is high, and this effect is particularly remarkable when a solid pattern is printed.

When the water-soluble polymer is carboxymethyl cellulose (hereinafter referred to as CMC), the gelling agent is preferably calcium ions or barium ions. When the water-soluble polymer is sodium alginate, the gelling agent is preferably calcium ions. When the water-soluble polymer is polyvinyl alcohol, the gelling agent is preferably sulfuric acid ions, carbonic acid ions, phosphoric acid ions, potassium ions, sodium ions, ammonium ions or lithium ions.

Now, a description will be made with reference to an ink containing CMC, but the same is applicable also to cases of other water-soluble polymers. In the case of an ink containing CMC, highly uniform recording is possible when calcium ions or barium ions are contained in the alumina hydrate layer. Magnesium ions which are ions of a Group 2A element like calcium ions or barium ions, are poor in the effects and substantially useless.

The calcium ions or the barium ions are preferably supported in the alumina hydrate layer in the form of a salt. For example, a halide such as a chloride or a fluoride, an inorganic acid salt such as a sulfate or a nitrate, an organic salt such as an acetate, or a hydrate thereof, may be used. Specifically, $CaCl_2.2H_2O$, $BaCl_2.2H_2O$ or $Ba(CH_3COO)_2$ may, for example, be mentioned. The calcium ions or the barium ions may be contained in the form of a hydroxide instead of in the form of a salt. They provide similar effects even when they are adsorbed in the form of ions in the alumina hydrate.

The calcium ions or the barium ions are preferably in an amount of from 10 to 1,000 wt ppm to the alumina hydrate. If the amount of the calcium ions or the barium ions is less than this range, no adequate effects of the present invention tend to be obtained, and nonuniformity of an image is likely to result when recording is carried out with an ink containing CMC. On the other hand, if the amount exceeds this range, the image quality is likely to deteriorate just like the case where the amount is too small. A preferred range is from 50 to 400 wt ppm.

As the substrate for the recording sheet of the present invention, there is no particular limitation, and various materials may be used. Specifically, various plastic materials including a polyester resin such as polyethylene terephthalate, a polycarbonate resin, a fluorine resin such as ETFE, or paper materials may suitably be used. As the substrate fabric or metallic materials may be used. Further, for the purpose of improving the bond strength of the alumina hydrate layer, it is possible to apply corona discharge treatment or undercoating. The substrate material may be transparent or opaque.

As the alumina hydrate, pseudoboehmite ($Al_2O_3.nH_2O$, n=1 to 1.5), is preferred, since it well absorbs and fix a colorant. The alumina hydrate layer formed on the substrate is preferably porous. It preferably has a structure having alumina hydrate particles bonded by a binder. The porous structure is preferably such that it has pores having an average pore radius of from 1 to 15 nm, and the pore volume is from 0.3 to 1.0 cc/g, whereby the alumina hydrate layer has an adequate absorbing property and transparency. Here, if the substrate is transparent, a transparent recording sheet can be obtained, so that it is useful also for an overhead projector. Also when the substrate is opaque, an image of high quality can be obtained, which does not impair the quality of the substrate.

In addition to these physical properties, it is more preferred that the average pore radius of the alumina hydrate layer is from 3 to 10 nm. The pores can be measured by a nitrogen absorption and desorption method.

As a method for forming the porous alumina hydrate layer on the substrate, a method may be employed wherein a binder and a solvent are added to the alumina hydrate to obtain a sol-like coating solution, which is then coated on a substrate, followed by drying. In a case where the alumina sol is applied as mixed with a binder, it is readily possible to form an alumina hydrate layer having the above described porous properties. As a coating means, a roll coater, an air knife coater, a blade coater, a rod coater, a bar coater or a comma coater may, for example, be employed. The solvent for the coating solution may be aqueous or non-aqueous.

As the binder, an organic material such as starch or its modified product, polyvinyl alcohol or its modified product, SBR latex, NBR latex or polyvinylpyrrolidone, may be employed. The binder is used preferably in an amount of from 5 to 50 wt %, based on the alumina hydrate. If the amount of the binder is less than 5 wt %, the strength of the alumina hydrate layer tends to be inadequate. On the other hand, if it exceeds 50 wt %, the ink absorption tends to be inadequate.

The thickness of the alumina hydrate layer is appropriately selected depending upon the specification of the printer used, but it is usually preferably from 5 to 100 μm. If the thickness of the alumina hydrate layer is less than 5 μm, the ink absorption tends to be inadequate. On the other hand, if it exceeds 100 μm, the transparency of the alumina hydrate layer tends to be impaired, or the strength of the layer tends to be low.

The calcium ions or barium ions may be incorporated to the above coating solution, so that they may be simultaneously coated. Otherwise, after forming the alumina hydrate layer, a solution containing calcium ions or barium ions may be impregnated to the alumina hydrate layer. Specifically, in a case where a salt containing the calcium ions or the barium ions is water-soluble, a method may be employed in which such a salt is made into an aqueous solution, and a recording sheet having an alumina hydrate layer formed thereon, is dipped in this solution, then withdrawn and dried by e.g. warm wind. As the application method of the solution, gravure coater or spraying may be employed.

In the present invention, the gelling agent for the water-soluble polymer increases the viscosity of ink by the interaction with the water-soluble polymer in the ink, when the ink is attached to the recording sheet, whereby unnecessary migration of the ink after printing is prevented, and consequently, a high level of uniformity of the image can be accomplished.

Now, the present invention will be described in further detail with reference to Examples. However, it should be understood that the present invention is by no means restricted to such specific Examples.

EXAMPLE 1

Into a glass reactor having a capacity of 2,000 cc, 540 g of water and 676 g of isopropyl alcohol were charged and heated by a mantle heater so that the liquid temperature became 75° C. While stirring, 306 g of aluminum isopropoxide was added thereto, and hydrolysis was carried out for 15 hours while maintaining the liquid temperature at a level of from 75° to 78° C. Then, the temperature was raised to 95° C., and 9 g of acetic acid was added thereto, and the mixture was maintained for 48 hours at a temperature of from 90° to 95° C. for peptization. Further, this liquid mixture was concentrated to 900 g to obtain a white sol. The dried product of this sol was pseudoboehmite.

100 g of the alumina sol having a solid content of 18 wt %, thus prepared, 32 g of an aqueous solution containing 6.2 wt % of polyvinyl alcohol, and 13 mg of $CaCl_2.2H_2O$ were mixed to obtain a coating solution. This coating solution was coated by a bar coater on a transparent polyethylene terephthalate film (thickness: 100 μm) so that the film thickness after drying would be 20 μm. The coated solution was dried and then heat-treated at 140° C. to obtain a transparent recording sheet. The coating layer had an average pore radius of 5.5 μm and a pore volume of 0.5 cc/g. An amount of the calcium ion in the alumina hydrate layer was 200 wt ppm to the alumina hydrate.

EXAMPLE 2

A transparent recording sheet was prepared in the same manner as in Example 1 except that 6.4 mg of $BaCl_2.2H_2O$ was used instead of 13 mg of $CaCl_2.2H_2O$. An amount of the barium ion in the alumina hydrate layer was 200 wt ppm to the alumina hydrate.

EXAMPLE 3

A transparent recording sheet which was prepared in the same manner as in Example 1 except that no $CaCl_2.2H_2O$ was employed. This sheet was dipped in a 0.1 wt % aqueous solution of $CaCl_2.2H_2O$, and dried. An amount of the calcium ion in the alumina hydrate layer was 200 wt ppm to the alumina hydrate.

EXAMPLE 4

A transparent recording sheet which was prepared in the same manner as in Example 1 except that no $CaCl_2.2H_2O$ was employed. This sheet was dipped in a 0.1 wt % aqueous solution of $BaCl_2.2H_2O$, and dried. An amount of the barium ion in the alumina hydrate layer was 400 wt ppm to the alumina hydrate.

COMPARATIVE EXAMPLE 1

A transparent recording sheet was prepared in the same manner as in Example 1 except that no $CaCl_2.2H_2O$ was employed.

PRINTING EXAMPLE

With respect to the above recording sheets, recording was carried out by an ink jet system (using Desk Writer 310, tradename for a printer manufactured by Hewlett Packard Company) using an ink having CMC incorporated in an aqueous solvent. Solid patterns were printed with three colors applied one on another. With the recording sheets prepared in Examples 1, 2, 3 and 4, uniform records excellent in both the color density and the resolution were obtained. With the recording sheet of Comparative Example, color shading was remarkable.

We claim:

1. A method of ink jet recording, which comprises:

applying an ink containing a water-soluble polymer onto a recording sheet comprising (i) a substrate and (ii) a porous alumina hydrate layer thereon which contains a gelling agent for said water-soluble polymer; and gelling the water-soluble polymer.

2. The method according to claim 1, wherein the water-soluble polymer is carboxymethyl cellulose, and the gelling agent is calcium ions or barium ions.

3. The method according to claim 1, wherein the calcium ions or the barium ions are contained in the form of a salt.

4. The method according to claim 3, wherein the calcium ions or the barium ions are contained in the form of at least one member selected from the group consisting of chlorides, fluorides, sulfates, nitrates and acetates.

5. The method according to claim 1, wherein calcium ions or the barium ions are from 10 to 1,000 wt ppm to the alumina hydrate.

6. The method according to claim 1, wherein the alumina hydrate is pseudoboehmite.

7. The method according to claim 1, wherein the porous alumina hydrate layer contains from 5 to 50 wt % of a binder to the alumina hydrate.

8. The method according to claim 1, wherein the average pore radius of the porous alumina hydrate layer is from 1 to 15 nm, and the pore volume is from 0.3 to 1.0 cc/g.

9. The method according to claim 1, wherein the thickness of the porous alumina hydrate layer is from 5 to 100/μm.

10. The method according to claim 1, wherein the water-soluble polymer is sodium alginate, and the gelling agent is calcium ions.

11. The method according to claim 1, wherein the water-soluble polymer is polyvinyl alcohol, and the gelling agent is sulfuric acid, carbonic acid, phosphoric acid, potassium ions, sodium ions, ammonium ions or lithium ions.

* * * * *